US006806585B2

(12) United States Patent
Park

(10) Patent No.: US 6,806,585 B2
(45) Date of Patent: Oct. 19, 2004

(54) STABILIZATION CIRCUIT OF MAGNET SWITCH FOR STARTER

(75) Inventor: Hyung-Bo Park, Ulsan-si (KR)

(73) Assignee: Valeo Mando Electrical Systems Korea Limited, Kyongsangbuk-do (KR)

( * ) Notice: Subject to any disclaimer, the term of this patent is extended or adjusted under 35 U.S.C. 154(b) by 154 days.

(21) Appl. No.: 10/309,796

(22) Filed: Dec. 4, 2002

(65) Prior Publication Data

US 2004/0108725 A1 Jun. 10, 2004

(51) Int. Cl.[7] ..... F02N 11/00
(52) U.S. Cl. ..... 290/38 R; 123/179.3
(58) Field of Search ..... 290/38 R, 38 A, 290/31; 123/179.3, 198 D

(56) References Cited

U.S. PATENT DOCUMENTS 4,755,688 A * 7/1988 Isozumi ..... 290/38 R
5,155,374 A * 10/1992 Shirata et al. ..... 290/38 R
5,157,267 A * 10/1992 Shirata et al. ..... 290/38 R
5,563,454 A * 10/1996 Araki et al. ..... 307/10.6
5,831,804 A * 11/1998 Vilou ..... 361/28
5,967,106 A * 10/1999 Schulze et al. ..... 123/179.3
6,050,233 A * 4/2000 Vilou ..... 123/179.3
6,148,781 A * 11/2000 Boegner et al. ..... 123/179.3
6,595,179 B1 * 7/2003 Kanno ..... 123/198 D

* cited by examiner

*Primary Examiner*—Nicholas Ponomarenko
(74) *Attorney, Agent, or Firm*—R. Neil Sudol; Henry D. Coleman; William J. Sapone

(57) ABSTRACT

The present invention relates to a stabilization circuit of a magnet switch for a starter in which an electronic switch of a starter which starts an engine installed in a vehicle is stable-operated. In the present invention, a current is prevented to flow to a pull-in coil and holding coil when disconnecting a key switch using a diode which is capable of flowing a current in a normal direction and preventing a flow of a current in a reverse direction, so that it is possible to accurately return a plunger to its original state. Therefore, the operation of a motor unit is stopped by opening two contact points. In the case that a key switch is turned on by connecting a diode between the contact points and the pull-in coil, the pull-in coil and holding coil are magnetized, and in the case that the key switch is turned off, the current is not flown to the pull-in coil and holding coil, so that the pull-in coil and holding coil are not magnetized.

1 Claim, 1 Drawing Sheet

[fig 1] Prior Art
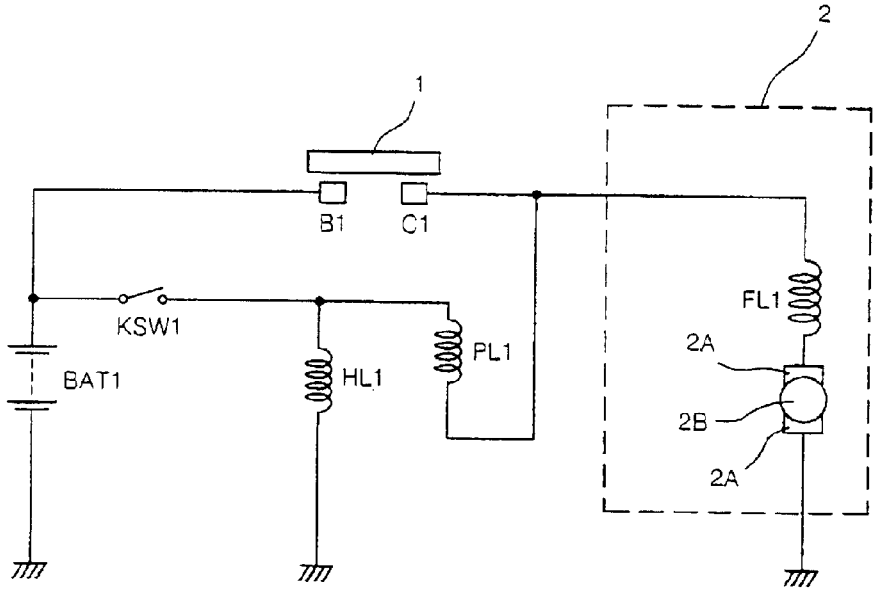
[fig 2]
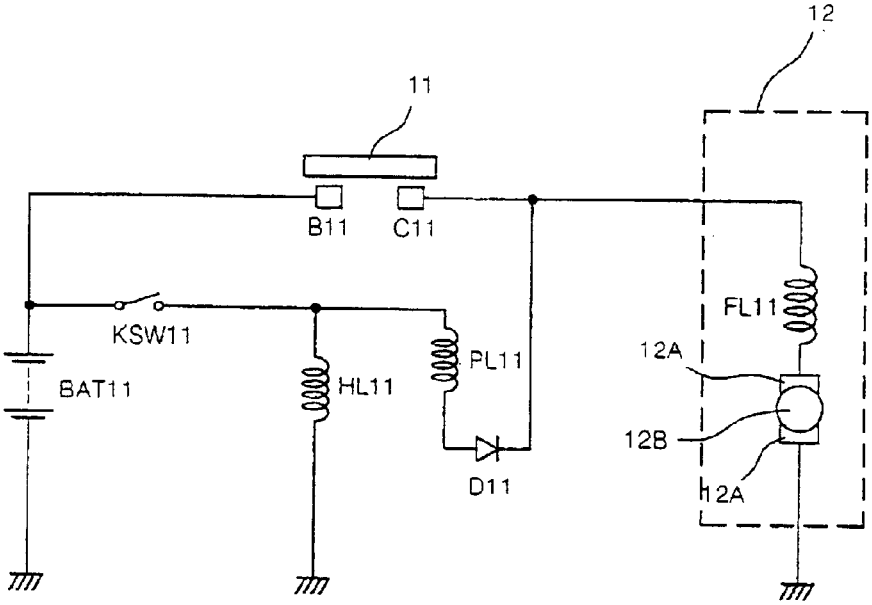

STABILIZATION CIRCUIT OF MAGNET SWITCH FOR STARTER

BACKGROUND OF THE INVENTION

1. Field of the Invention

The present invention relates to a stabilization circuit of a magnet switch for a starter which is capable of implementing a stabilized operation of an electronic switch of a starter which starts an engine installed in a vehicle.

2. Description of the Background Art

An engine installed in a vehicle is an internal combustion engine which can not start by itself, so that in order to start the engine, a crank shaft is rotated by an external force.

In addition, in case the crank shaft of the engine does not exceed a certain revolution, the engine may not be started.

Therefore, a starter is installed in an engine wherein a motor is installed therein for revolving a crank shaft of an engine at a certain revolution and an auxiliary apparatus is installed for controlling a driving operation of the motor.

The motor of a starter should revolve a crank shaft at a certain revolution capable of starting the engine by overcoming a capacity of an engine cylinder, a compression capacity and friction force, so that a larger start torque is required. In addition, the motor is preferably designed to be small and light. Therefore, a direct current series motor is generally adopted.

A magnet switch is generally adopted to drive a motor of such a starter.

The above magnet switch includes two contact points capable of connecting a power of a battery to a motor unit or disconnecting the same, and a plunger capable of connecting and disconnecting the above two contact points. When a key switch is turned on, a pull-in coil is adopted to connect two contact points by the plunger, and a holding coil is adopted to keep the plunger connecting two contact points.

The above magnet switch will be described in detail with reference to FIG. 1.

FIG. 1 is a circuit diagram illustrating the constitution of a conventional magnet switch for a starter. As shown therein, a power of a battery($BAT_1$) is connected in such a manner that the power is supplied to a contact point($B_1$) of one side, and the power of the battery($BAT_1$) is applied to a holding coil($HL_1$) which maintains a absorption state of the plunger 1 through a key switch($KSW_1$), and the contact point is connected with a field coil($FL_1$) of the motor unit 2 and an armature 2B through a brush 2A together with the contact point($C_1$) of the other side through the pull-in coil($PL_1$) which absorbs the plunger 1.

In the thusly constructed conventional magnet switch for a starter, when a key switch($KSW_1$) is connected for driving an engine, the power of the battery(($BAT_1$) is connected to the key switch($KSW_1$) and is applied to a holding coil($HL_1$). The above power is flown to the ground through the pull-in coil($PL_1$), the field coil($FL_1$) of the motor unit 2, a brush 2A, an armature 2B and a brush 2A.

Therefore, the holding coil($HL_1$) and the pull-in coil($PL_1$) are magnetized for thereby generating a magnetic force line.

At this time, the magnetic force lines generated by the holding coil($HL_1$) and the pull-in($PL_1$) are formed in the same direction and absorb the plunger 1, so that the plunger 1 contacts with two contact points ($B_1$) and ($C_1$), whereby the contact points ($B_1$) and ($C_1$) are connected each other.

In addition, the power of the battery($BAT_1$) is supplied to the motor unit 2, but the current applied thereto is small, so that the motor unit 2 is not driven.

When two contact points ($B_1$) and ($C_1$) are connected by the plunger 1, since the power of the battery ($BAT_1$) is flown to the motor unit 2 sequentially through the contact point ($B_1$) the plunger 1 and the contact point($C_1$), so that the motor unit 2 is driven for thereby driving an engine.

At this time, since two contact points ($B_1$) and ($C_1$) are connected through the plunger 1, the electric potentials at both ends of the pull-in coil($PL_1$) are same, so that the pull-in coil($PL_1$) does not operate, whereby the magnetic force lines are not formed. The absorption state of the plunger 1 is continuously maintained based on the magnetic force lines generated by the holding coil($HL_1$), so that two contact points($B_1$) and ($C_1$) are continuously connected.

In the above state, when the engine starts and is driven, and when the key switch($KSW_1$) is opened, at the first time when the key switch($KSW_1$) is opened, the power of the battery($BAT_1$) is connected to the ground sequentially through the contact point($B_1$), the plunger 1, the contact point($C_1$), the pull-in coil($PL_1$) and the holding coil($HL_1$).

At this time, the current flowing to the pull-in coil($PL_1$) is flown in the direction reversed to the direction when the key switch($KSW_1$) is connected. Therefore, the magnetic force lines generated by the pull-in coil($PL_1$) and the holding coil($HL_1$) are offset, so that the plunger 1 is returned to its original state, and the contact points ($B_1$) and ($C_1$) are opened.

However, in the conventional art, when the magnet switch disconnects the key switch($KSW_1$), if the sizes of the magnetic force lines generated by the pull-in coil($PL_1$) and the holding coil($HL_1$) are not same, the sizes of the magnetic force lines generated by the pull-in coil($PL_1$) and the holding coil($HL_1$) are not same.

In the above case, the generated magnetic force lines are fully not offset, namely, remain, so that the plunger 1 maintains a absorption state. In the state that the engine is stopped, the plunger 1 may continuously connect the contain points ($B_1$) and ($C_1$), so that the motor unit 2 may not stop.

In addition, in order to implement the same sizes of the magnetic force lines generated by the pull-in coil($PL_1$) and the holding coil($HL_1$), the numbers of the windings of the pull-in coil($PL_1$) and the holding coil($HL_1$) may be same. In this case, there may be difficulties in the design and fabrication. In addition, the productivity of the product is decreased.

SUMMARY OF THE INVENTION

Accordingly, it is an object of the present invention to provide a stabilization circuit of a magnet switch for a starter which is capable of disconnecting a current in the directions of a pull-in coil and holding coil in the case that a key switch is disconnected for thereby returning a plunger to its original state and stopping the operation of a motor unit by opening two contact points.

To achieve the above objects, there is provided a stabilization circuit of a magnet switch for a starter which includes a motor unit 12 which starts an engine; a pull-in coil($PL_{11}$) and holding coil($HL_{11}$) which are magnetized and generate a magnetic force line when a key switch($KSW_{11}$) is turned on; a plunger 11 which is absorbed by a magnetic force line generated by the pull-in coil($PL_{11}$) and holding coil($HL_{11}$) and supplies a driving power to the motor unit 12 by connecting contact points ($B_{11}$) and ($C_{11}$) for thereby supplying a driving force to the motor unit 12 and prevents the pull-in coil($PL_{11}$) from being magnetized; and a diode($D_{11}$) which prevents a power flown through the contact points ($B_{11}$) and ($C_{11}$) and the plunger 11 from being flown to the pull-in coil($PL_{11}$) and the holding coil($HL_{11}$) when the key switch($KSW_{11}$) is disconnected.

BRIEF DESCRIPTION OF THE DRAWINGS

The present invention will become better understood with reference to the accompanying drawings which are given only by way of illustration and thus are not limitative of the present invention, wherein;

FIG. 1 is a circuit diagram illustrating the construction of a conventional magnet switch for a starter; and FIG. 2 is a circuit diagram illustrating the construction of a magnet switch for a starter according to the present invention.

DETAILED DESCRIPTION OF THE PREFERRED EMBODIMENTS

The stabilization circuit of a magnet switch for a starter according to the present invention will be described with reference to FIG. 2.

FIG. 2 is a circuit diagram illustrating the construction of a magnet switch for a starter according to the present invention.

As shown therein, a battery($BAT_1$) is connected in such a manner that a power of the same is applied to a contact point($B_{11}$) of one side, and the power of the same is applied to a holding coil($HL_{11}$) which maintains a absorpction state of a plunger 11. The contact point is connected to an armature 12B through the field coil($FL_{11}$) of a motor unit 12 and a brush 12A together with a contact point of the other side through the pull-in coil($PL_{11}$) and a diode($D_{11}$) which absorb the plunger 11.

In the above stabilization circuit of a magnet switch for a starter according to the present invention, when a key switch($KSW_{11}$) is connected for starting an engine, the power of the battery($BAT_{11}$) flows through the key switch ($KSW_{11}$) and is applied to the holding coil($HL_{11}$) and flows to the motor unit 12 through the pull-in coil($PL_{11}$) and the diode($D_{11}$).

Therefore, the holding coil($HL_{11}$) and the pull-in coil ($PL_{11}$) are magnetized for thereby forming magnetic force lines, and the plunger 11 is absorbed by the thusly generated magnetic force lines, so that two contact points($B_{11}$) and ($C_{11}$) are connected.

When two contact points($B_{11}$) and ($C_{11}$) are connected, since the power of the battery($BAT_{11}$) is applied to the motor unit 12 sequentially through the contact point($B_{11}$), the plunger 11 and the contact point($C_{11}$), so that motor unit 12 is driven for thereby starting the engine.

At this time, the electric potentials at both ends of the pull-in coil($PL_{11}$) are same, so that the magnetic force lines are not formed. Therefore, the absorption state of the plunger 11 is continuously maintained by the magnetic force lines generated by the holding coil($HL_{11}$), so that two contact points($B_{11}$) and ($C_{11}$) are continuously connected.

In the above state, when the engine is stopped, and the key switch($KSW_{11}$) is opened, at the first time when it is opened, the power of the battery($BAT_{11}$) flows through the contact point($B_{11}$), the plunger 11 and the contact point($C_{11}$), but the power of the same does not flow in the direction of the pull-in coil($PL_{11}$) and the holding coil($HL_{11}$) by the diode ($D_{11}$), so that the pull-in coil($PL_{11}$) and the holding coil ($HL_{11}$) are not magnetized, whereby the magnetic force lines are not formed. Therefore, the plunger 11 is returned to its original state, and the contact points($B_{11}$) and ($C_{11}$) are opened, so that the motor unit 12 is stopped.

As described above, in the present invention, in the case that the key switch is turned off, the current does not flow to the pull-in coil and holding coil, so that the pull-in coil and holding coil are not magnetized. Therefore, the plunger is accurately returned to its original state, so that the motor unit is stopped.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A stabilization circuit of a magnet switch for a starter, comprising:

a motor unit 12 which starts an engine;

a pull-in coil($PL_{11}$) and holding coil($HL_{11}$) which are magnetized and generate a magnetic force line when a key switch($KSW_{11}$) is turned on;

a plunger 11 which is absorbed by a magnetic force line generated by the pull-in coil($PL_{11}$) and holding coil ($HL_{11}$) and supplies a driving power to the motor unit 12 by connecting contact points ($B_{11}$) and ($C_{11}$) for thereby supplying a driving force to the motor unit 12 and prevents the pull-in coil($PL_{11}$) from being magnetized; and a diode($D_{11}$) which prevents a power flown through the contact points($B_{11}$) and ($C_{11}$) and the plunger 11 from being flown to the pull-in coil($PL_{11}$) and the holding coil($HL_{11}$) when the key switch($KSW_{11}$) is disconnected.

* * * * *